US010976057B2

(12) United States Patent
Kobayashi et al.

(10) Patent No.: US 10,976,057 B2
(45) Date of Patent: Apr. 13, 2021

(54) COOKER

(71) Applicants: Mitsubishi Electric Corporation, Tokyo (JP); Mitsubishi Electric Home Appliance Co., Ltd., Fukaya (JP)

(72) Inventors: Akihiko Kobayashi, Tokyo (JP); Hayato Yoshino, Tokyo (JP)

(73) Assignees: Mitsubishi Electric Corporation, Tokyo (JP); Mitsubishi Electric Home Appliance Co., Ltd., Fukaya (JP)

( * ) Notice: Subject to any disclaimer, the term of this patent is extended or adjusted under 35 U.S.C. 154(b) by 178 days.

(21) Appl. No.: 16/098,259

(22) PCT Filed: Nov. 17, 2016

(86) PCT No.: PCT/JP2016/084036
§ 371 (c)(1),
(2) Date: Nov. 1, 2018

(87) PCT Pub. No.: WO2018/020700
PCT Pub. Date: Feb. 1, 2018

(65) Prior Publication Data

US 2019/0137111 A1 May 9, 2019

(30) Foreign Application Priority Data

Jul. 29, 2016 (JP) ..... JP2016-149833

(51) Int. Cl.
*F24C 15/18* (2006.01)
*H05B 6/12* (2006.01)
*F24C 15/10* (2006.01)

(52) U.S. Cl.
CPC ..... *F24C 15/18* (2013.01); *F24C 15/108* (2013.01); *H05B 6/1209* (2013.01); *H05B 6/1263* (2013.01)

(58) Field of Classification Search
None
See application file for complete search history.

(56) References Cited

U.S. PATENT DOCUMENTS 2,083,145 A * 6/1937 Campbell ..... F24C 15/18 126/4
2,584,187 A * 2/1952 Crist ..... F24C 15/18 219/386

(Continued)

FOREIGN PATENT DOCUMENTS

JP H11-276354 A 10/1999
JP 2011-004988 A 1/2011

(Continued)

OTHER PUBLICATIONS

Office Action dated Oct. 1, 2019 issued in corresponding JP patent application No. 2018-529349 (and English translation).

(Continued)

*Primary Examiner* — Thor S Campbell
(74) *Attorney, Agent, or Firm* — Posz Law Group, PLC

(57) ABSTRACT

A cooker includes a top plate provided with a plurality of cooking zones on any of which a heating object is to be placed, a plurality of heaters each provided to a corresponding one of the plurality of cooking zones, a housing provided below the top plate and accommodating the plurality of heaters, a storage defined by a partition and provided in the housing, a door configured to cover an opening provided at the housing and communicating with the storage, and a storage case attached to the door and stored in the storage. A center of gravity of the cooker is positioned closer to a width-direction center of the housing than a width-direction end of the housing.

13 Claims, 13 Drawing Sheets

(56) References Cited

U.S. PATENT DOCUMENTS 3,477,420 A * 11/1969 Rogers, Jr. ..... F24C 15/18 126/299 D
3,587,555 A * 6/1971 Cerola ..... F24C 15/2042 126/11
4,071,739 A * 1/1978 Jenn ..... F24C 15/325 219/400
4,899,028 A * 2/1990 Arai ..... F24C 15/101 126/21 A
4,962,694 A * 10/1990 Graver ..... A47J 36/38 126/21 A
8,875,695 B2 * 11/2014 Yi ..... F24C 15/30 126/214 A
8,991,385 B2 * 3/2015 Kwon ..... F24C 3/067 126/37 A
2007/0062513 A1 * 3/2007 Gagas ..... F24C 15/2021 126/299 D
2009/0194527 A1 * 8/2009 Okada ..... H05B 6/1263 219/624
2010/0163549 A1 * 7/2010 Gagas ..... F24C 15/2042 219/622
2011/0303651 A1 * 12/2011 Mineoka ..... F24C 15/327 219/432
2012/0272832 A1 * 11/2012 Kwon ..... F24C 15/16 99/324
2012/0305544 A1 * 12/2012 Oagley ..... H05B 6/1263 219/622
2013/0307385 A1 * 11/2013 Bringe ..... F24C 15/18 312/237

FOREIGN PATENT DOCUMENTS

JP 2011-023374 A 2/2011
JP 2011-024912 A 2/2011
JP 2012-007850 A 1/2012
JP 2013-251087 A 12/2013
JP 2015-162319 A 9/2015

OTHER PUBLICATIONS

International Search Report of the International Searching Authority dated Feb. 14, 2017 for the corresponding International application No. PCT/JP2016/084036 (and English translation).
Office Action dated Sep. 27, 2020 issued in corresponding CN patent application No. 201680087642.7 (and English translation).

* cited by examiner

COOKER

CROSS REFERENCE TO RELATED APPLICATION

This application is a U.S. national stage application of PCT/JP2016/084036 filed on Nov. 17, 2016, the contents of which are incorporated herein by reference.

TECHNICAL FIELD

The present invention relates to a cooker including a heater that heats a heating object to be placed on a top plate, and a storage provided in a housing of the cooker.

BACKGROUND ART

There have been cookers that each include a top plate provided above a housing of the cooker and heat a heating object to be placed on the top plate. As an example of such a cooker, a cooker has been proposed that includes an article storage provided in a housing of the cooker (see Patent Literature 1, for example).

CITATION LIST

Patent Literature

Patent Literature 1: Japanese Unexamined Patent Application Publication No. 11-276354 (page 6)

SUMMARY OF INVENTION

Technical Problem

The cooker disclosed in Patent Literature 1 includes a storage in a housing of the cooker. In a state where the cooker is being used, pieces of stuff such as cookware, table ware, and seasonings are stored in the storage. However, Patent Literature 1 gives no consideration for the ease of work in transporting the cooker including the storage and in installing the cooker into a kitchen furniture item.

When a cooker including a storage in a housing of the cooker is transported or installed, the worker usually carries the cooker by holding the left and right of the cooker. In this state, the storage in the housing is empty. Consequently, depending on the arrangement of heating coils and other components included in the cooker, when the worker holds the left and right of the cooker and lifts up the cooker, the weight borne by the worker may be unbalanced. In such a case, the worker may drop the cooker. When the weight borne by the worker is unbalanced, the worker needs to bear such a load at the time of transport and installation. Consequently, the efficiency in the work may be reduced.

The present invention has been conceived in view of the above problems and improves the portability of a cooker including a storage in a housing of the cooker.

Solution to Problem

A cooker according to an embodiment of the present invention includes a top plate provided with a plurality of cooking zones on any of which a heating object is to be placed, a plurality of heaters each provided to a corresponding one of the plurality of cooking zones, a housing provided below the top plate and accommodating the plurality of heaters, a storage defined by a partition and provided in the housing, a door configured to cover an opening provided at the housing and communicating with the storage, and a storage case attached to the door and stored in the storage. A center of gravity of the cooker is positioned closer to a width-direction center of the housing than a width-direction end of the housing.

Advantageous Effects of Invention

According to an above embodiment of the present invention, the portability of the cooker including the storage in the housing of the cooker can be improved.

DESCRIPTION OF EMBODIMENTS

Figure 1:
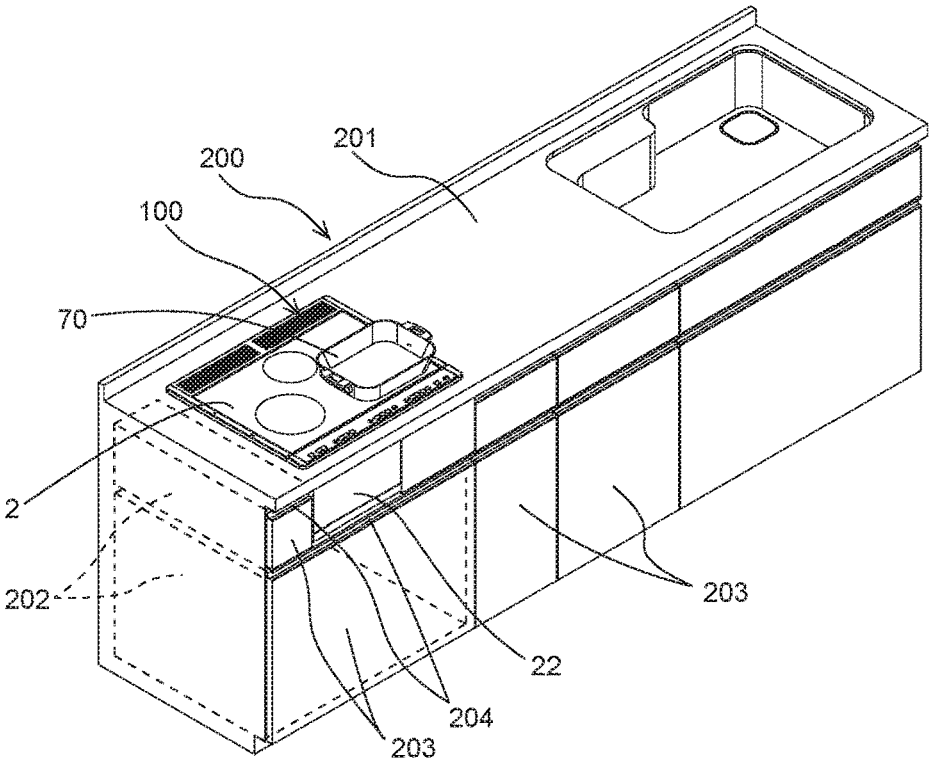
FIG. 1 is a perspective view of a kitchen furniture item equipped with a cooker according to Embodiment 1.

Embodiments of the cooker according to the present invention will be described below with reference to the drawings. The present invention is not limited to the following embodiments illustrated in the drawings. In the following description, terms (such as "top", "bottom", "right", "left", "front", and "rear") representing directions and used appropriately for easy understanding are only explanatory, and the present invention is not limited to the directions represented by the terms. In the drawings, the same reference signs denote the same or similar elements, and the reference signs are common throughout this specification. The relative sizes, the shapes, and other details of the elements illustrated in the drawings may be different from the actual ones.

Embodiment 1

FIG. 1 is a perspective view of a kitchen furniture item equipped with a cooker according to Embodiment 1. As illustrated in FIG. 1, a kitchen furniture item 200 includes a cooker 100 built in the kitchen furniture item 200. The kitchen furniture item 200 accommodates an accommodating portion (not illustrated) in which a housing 1 (see FIG. 2) of the cooker 100 is accommodated. The kitchen furniture item 200 has, at the top of the kitchen furniture item 200, a flat top board 201 used as a worktable. In a state where the cooker 100 is accommodated in the kitchen furniture item 200, a top plate 2 of the cooker 100 is exposed on the top board 201. The top plate 2 is provided with one or a plurality of cooking zones. For the convenience of description, FIG. 1 also illustrates a cooking pan 70 to be heated on the top plate 2.

The kitchen furniture item 200 has kitchen storages 202, inside the kitchen furniture item 200, in which pieces of stuff such as cookware and seasonings are to be stored. The kitchen furniture item 200 has, on the front face of the kitchen furniture item 200, kitchen-storage doors 203 that each opens and closes an opening provided at the front face of a corresponding one of the kitchen storages 202. The kitchen-storage doors 203 each have a handhold 204 used as a grip for opening and closing a corresponding one of the kitchen-storage doors 203. When the user pulls one of the handholds 204, a corresponding one of the kitchen-storage doors 203 that is provided with that handhold 204 opens. The kitchen-storage doors 203 may be each allowed to be slid in the depth direction or may be each allowed to be opened and closed about a hinge provided on a lateral portion, the lower portion, or the upper portion of the kitchen-storage door 203. In this specification, the "front face" of the cooker 100 or the "front face" of the kitchen furniture item 200 refers to a face of the cooker 100 or the kitchen furniture item 200 that faces the user.

The cooker 100 has a storage door 22 exposed on the front face of the cooker 100 and that opens and closes an open part at the front face of a storage 20 (see FIG. 3) provided in the cooker 100.

Figure 2:
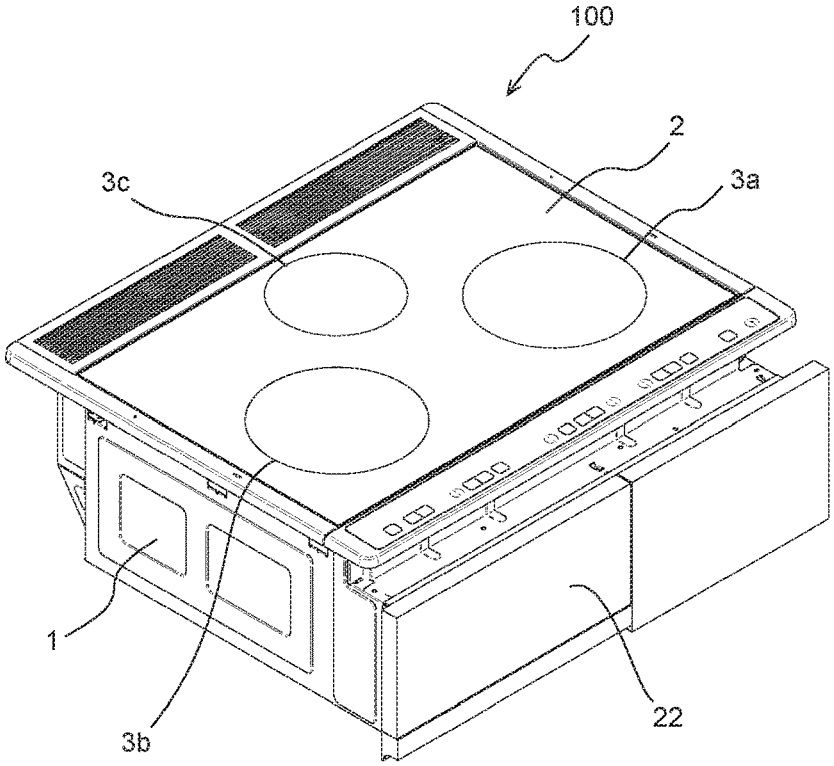
FIG. 2 is a perspective view of the cooker according to Embodiment 1.

FIG. 2 is a perspective view of the cooker according to Embodiment 1. The cooker 100 includes the housing 1 made of metal and in which components are accommodated. The housing 1 is provided, at the top of the housing 1, with the top plate 2 on which a cooking pan that is a heating object is to be placed. The top plate 2 is made of a nonmetallic material such as heat-resisting glass and ceramic. In Embodiment 1, the top plate 2 is enclosed by a metal frame.

The cooker 100 includes a cooking zone 3*a* that is a first cooking zone, a cooking zone 3*b* that is a second cooking zone, and a cooking zone 3*c*. The top plate 2 has, on the front or back surface of the top plate 2, indications that are marks representing positions of the cooking zones 3*a* to 3*c* on any of which the heating object is to be placed.

Figure 3:
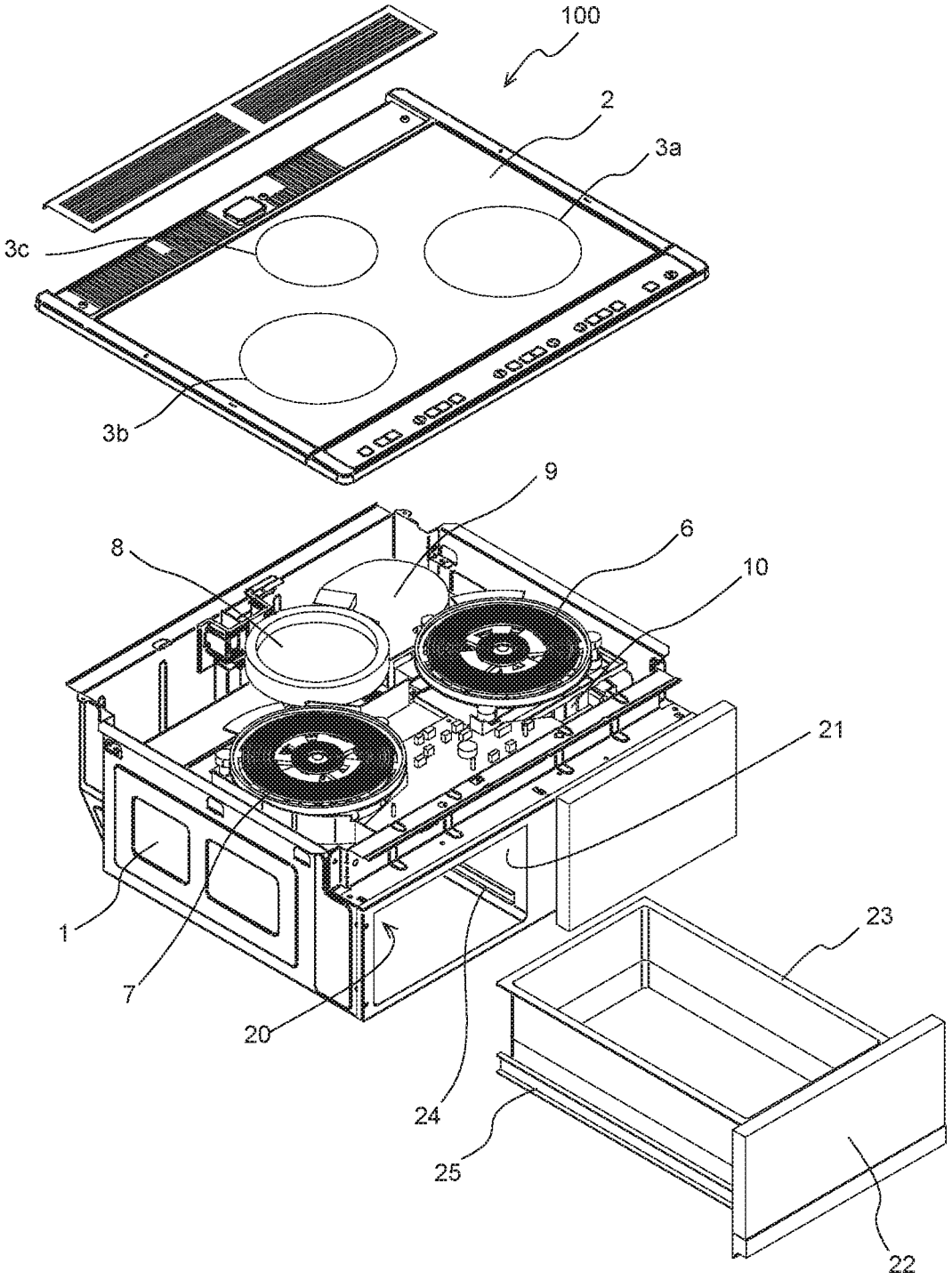
FIG. 3 is an exploded perspective view of the cooker according to Embodiment 1.

FIG. 3 is an exploded perspective view of the cooker according to Embodiment 1. The housing 1 of the cooker 100 has a substantially box-like shape with the top face of the housing 1 open. The housing 1 of the cooker 100 accommodates a first heating coil 6, a second heating coil 7 and a radiant heater 8 that are heaters any of which heats the heating object to be placed on the top plate 2. The first heating coil 6, the second heating coil 7, and the radiant heater 8 are respectively provided to the cooking zone 3*a*, the cooking zone 3*b*, and the cooking zone 3*c*. In Embodiment 1, the first heating coil 6 and the second heating coil 7 are positioned on the front portion in the housing 1 and are laterally arranged in the width direction of the housing 1, whereas the radiant heater 8 is positioned behind a position between the first heating coil 6 and the second heating coil 7. In Embodiment 1, it is only necessary that a plurality of heaters are provided, and the radiant heater 8 may be replaced with a heating coil. While FIG. 3 illustrates an exemplary case where a plurality of heaters are arranged in two rows that are on the front and rear portions, the plurality of heaters may be arranged in a single row in the width direction of the housing 1.

The housing 1 accommodates a circuit board 10 on which a drive circuit that is an inverter that supplies a high-frequency current to the first heating coil 6 and the second heating coil 7, a circuit that supplies power to the radiant heater 8, and a control circuit are mounted. The control circuit of the cooker 100 controls the heaters in accordance with inputs made by the user, thereby heating the heating object placed on the top plate 2. The cooker 100 may have a cooking menu for controlling the heating operation in accordance with predetermined control sequences.

An air-sending device 9 is provided in the housing 1 and behind the first heating coil 6. The air-sending device 9 feeds cooling air into the housing 1 and thus cools heat-generating components mounted on the circuit board 10, the first heating coil 6, and the second heating coil 7. The air-sending device 9 according to Embodiment 1 includes a plurality of blades, a motor that rotates the blades, and a casing that accommodates the blades and the motor.

The housing 1 has the storage 20 defined in a substantially cuboid shape. Walls that define the storage 20 in the housing 1 are generically referred to as a partition 21. The storage 20 has an open part at the front face of the storage 20. The open part is opened and closed by the storage door 22.

A box-shaped storage case 23 whose top face is open is connected to the storage door 22. As an opening-and-closing mechanism that supports the storage door 22 and the storage case 23 in such a manner that the storage door 22 and the storage case 23 are allowed to be moved away from and toward the partition 21 that defines the storage 20, Embodiment 1 employs fixed rails 24 and movable rails 25. The pair of left and right fixed rails 24 are each provided on a corresponding one of the left and right inner surfaces of the partition 21 of the storage 20. Likewise, the pair of left and right movable rails 25 are each provided on a lower portion of a corresponding one of the left and right faces of the storage case 23. The movable rail 25 is in engagement with each of the fixed rails 24 in such a manner that the movable rail 25 is allowed to be slid. With opening and closing of the storage door 22, the movable rails 25 move along the fixed rails 24. The storage door 22 and the storage case 23 are held in the storage 20 with the aid of the fixed rails 24 and the movable rails 25 in such a manner that the storage door 22 and the storage case 23 are allowed to be detached from the storage 20. For example, not only the cooking pan 70 to be used in the heating with the cooker 100 but also seasonings and other pieces of stuff are likely to be stored in the storage case 23. For this reason, the storage case 23 is required to be clean. Meanwhile, areas around the cooker 100 tend to become dirty with some food stuff, oil soot, steam, and other similar matter scattered during cooking. When the storage case 23 is allowed to be detached from the storage 20 as in Embodiment 1, the user can easily clean the storage case 23. When the cooker 100 has the cooking menu mentioned above, the capacity of the storage case 23 may be determined in such a manner that a cooking pan to be used for the cooking menu can be stored in the storage case 23. When the storage case 23 is designed to store such a dedicated cooking pan, the ease of work in cooking can be increased.

Figure 4:
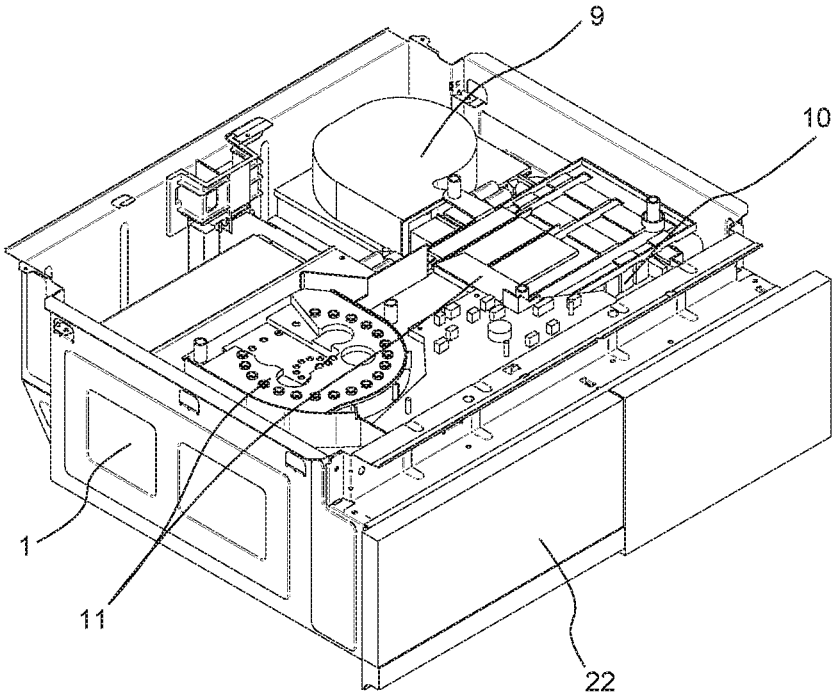
FIG. 4 is a perspective view of the cooker according to Embodiment 1, with a top plate and heaters of the cooker removed.

FIG. 4 is a perspective view of the cooker according to Embodiment 1, with the top plate and the heaters of the cooker removed. A coil-cooling duct 11 that guides the cooling air fed from the air-sending device 9 is provided below the first heating coil 6 and the second heating coil 7 (see FIG. 3). The coil-cooling duct 11 has an inlet that communicates with the air outlet of the air-sending device 9, and a plurality of air outlets that each communicate with a corresponding one of the first heating coil 6 and the second heating coil 7. The cooling air from the air-sending device 9 is separated at the plurality of air outlets and fed to the first heating coil 6 and the second heating coil 7. Thus, the coil-cooling duct 11 has a function of assisting the cooling of the first heating coil 6 and the second heating coil 7.

Figure 5:
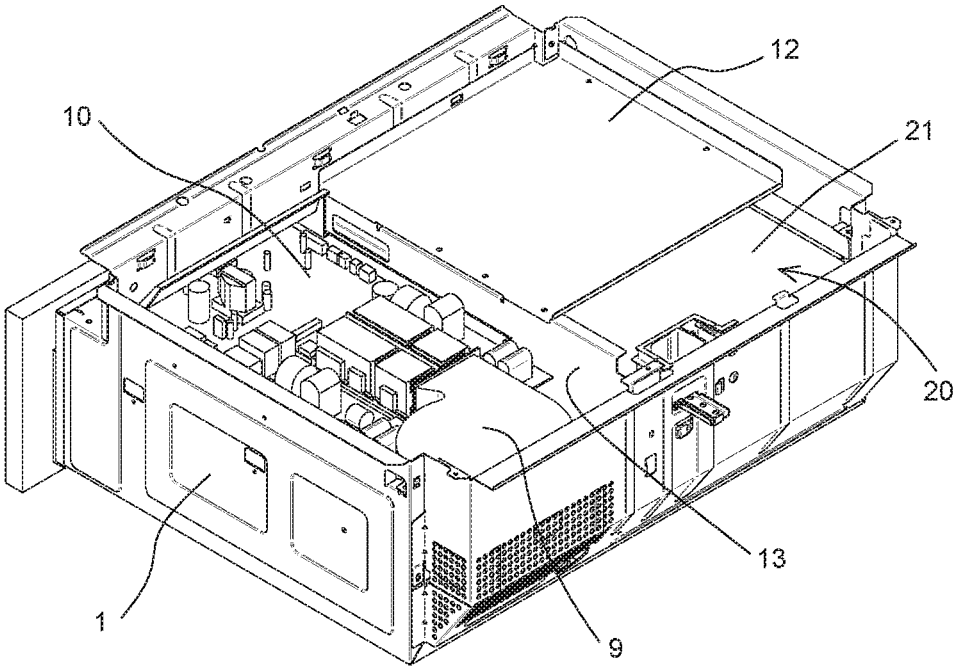
FIG. 5 is a diagram illustrating an internal configuration of the cooker according to Embodiment 1.

FIG. 5 is a diagram illustrating an internal configuration of the cooker according to Embodiment 1. FIG. 5 is a rear perspective view of the configuration illustrated in FIG. 4, with the coil-cooling duct 11 removed. A first facing wall 12 is provided above the top face of the partition 21 defining the storage 20. A second facing wall 13 is provided outside a side face of the partition 21 defining the storage 20. The first facing wall 12 and the second facing wall 13 are each, for example, a flat plate-like part made of metal. The first facing wall 12 and the second facing wall 13 are each away from the partition 21 defining the storage 20 with a gap defined between the first facing wall 12 and the partition 21 and a gap between the second facing wall 13 and the partition 21. The first facing wall 12 extends substantially parallel to the flat surface of the top plate 2 (see FIG. 3). The second facing wall 13 extends substantially perpendicularly to the first facing wall 12 and to the bottom face of the housing 1.

In the width direction of the housing 1, the storage 20 is positioned in one area across the second facing wall 13 from the other area, whereas the circuit board 10 and the air-sending device 9 are positioned in the other area.

Figure 6:
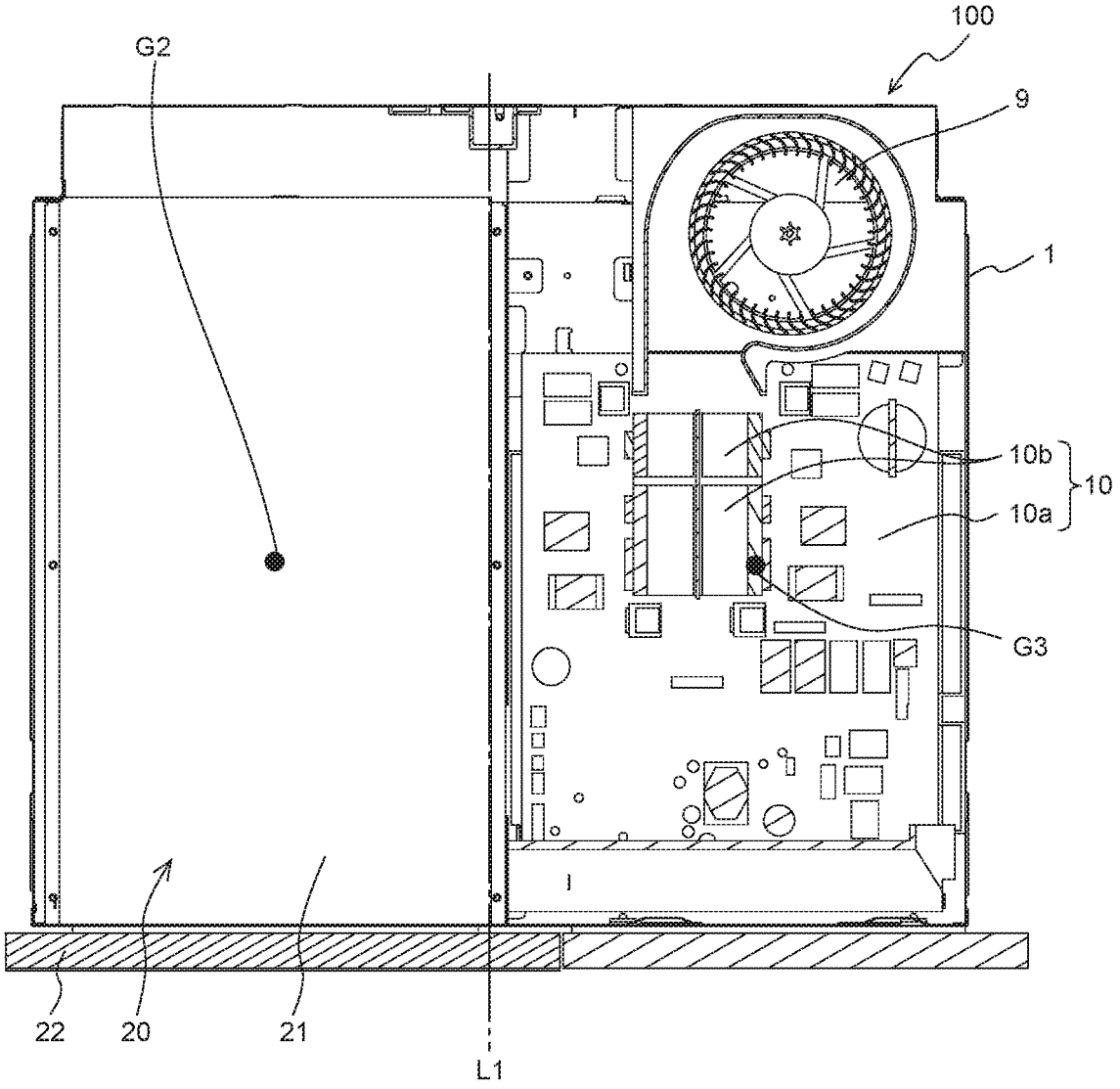
FIG. 6 is a diagram illustrating an arrangement of components included in the cooker according to Embodiment 1 and the centers of gravity of the components.

FIG. 6 is a diagram illustrating the arrangement of the components included in the cooker according to Embodiment 1 and the centers of gravity of the components. FIG. 6 illustrates a horizontal section of the cooker 100 that passes through the air-sending device 9. In FIG. 6, the center of the housing 1 in the width direction (the lateral direction in FIG. 6) is represented by a one-dot chain line denoted by reference sign L1. A major area of the storage 20 is positioned in the left area, which is the one area in the width direction of the housing 1 across the center line L1 from the other area. Whereas, a major area of each of the air-sending device 9 and the circuit board 10 is positioned in the right area, which is the other area in the width direction of the housing 1 across the center line L1 from the one area.

The centers of gravity will be described below. Herein, the center of gravity of the storage 20 will be described as the center of gravity of the whole set of the entirety of the partition 21 defining the storage 20, the storage door 22, and the components (the storage case 23, the fixed rails 24, and the movable rails 25) connected to the storage door 22. The circuit board 10 includes a substrate 10*a*, and an inverter 10*b* mounted on the substrate 10*a* and that drives the first heating coil 6 and the second heating coil 7. The substrate 10*a* carries circuits and components, as well as the inverter 10*b*. As a matter of convenience, the center of gravity of the circuit board 10 will be described on the premise that the circuit board 10 is made of the inverter 10*b* and the substrate 10*a*, which are each a component having a relatively large mass. Furthermore, although the air-sending device 9 may be integrally provided with an intake duct and a blowing duct as required, the center of gravity of the air-sending device 9 will be described on the premise that, as a matter of convenience, the air-sending device 9 is made of a plurality of blades, a motor that rotates the blades, and a casing that accommodates the blades and the motor.

In FIG. 6, the center of gravity of the storage 20 is denoted by reference sign G2, and the center of gravity of a set of the air-sending device 9 and the circuit board 10 is denoted by reference sign G3. As illustrated in FIG. 6, the center of gravity G2 of the storage 20 and the center of gravity G3 of the set of the air-sending device 9 and the circuit board 10 are positioned in respective areas of the housing 1 that are across the center line L1 from each other in the width direction. That is, the center of gravity G2 of the storage 20 is positioned in the left area across the center line L1 from the right area, whereas the center of gravity G3 of the set of the air-sending device 9 and the circuit board 10 is positioned in the right area across the center line L2 from the left area.

Thus, the centers of gravity of the storage 20 and the set of the air-sending device 9 and the circuit board 10 that are each provided to one cooker 100 according to Embodiment 1 are each positioned in a corresponding one of two areas that are across the center line L1 from each other. Consequently, it is easy to set the center of gravity of the cooker 100 as a whole at a position close to the width-direction center of the housing 1. As the center of gravity of the cooker 100 as a whole is positioned close to the width-direction center of the housing 1, the weight borne by the worker when the worker holds the left and right of the cooker 100 is well-balanced in the lateral direction. The portability of the cooker 100 can be improved, accordingly. Consequently, the ease of transport of the cooker 100 and the ease of work at the time of installation of the cooker 100 can be made better.

Figure 7:
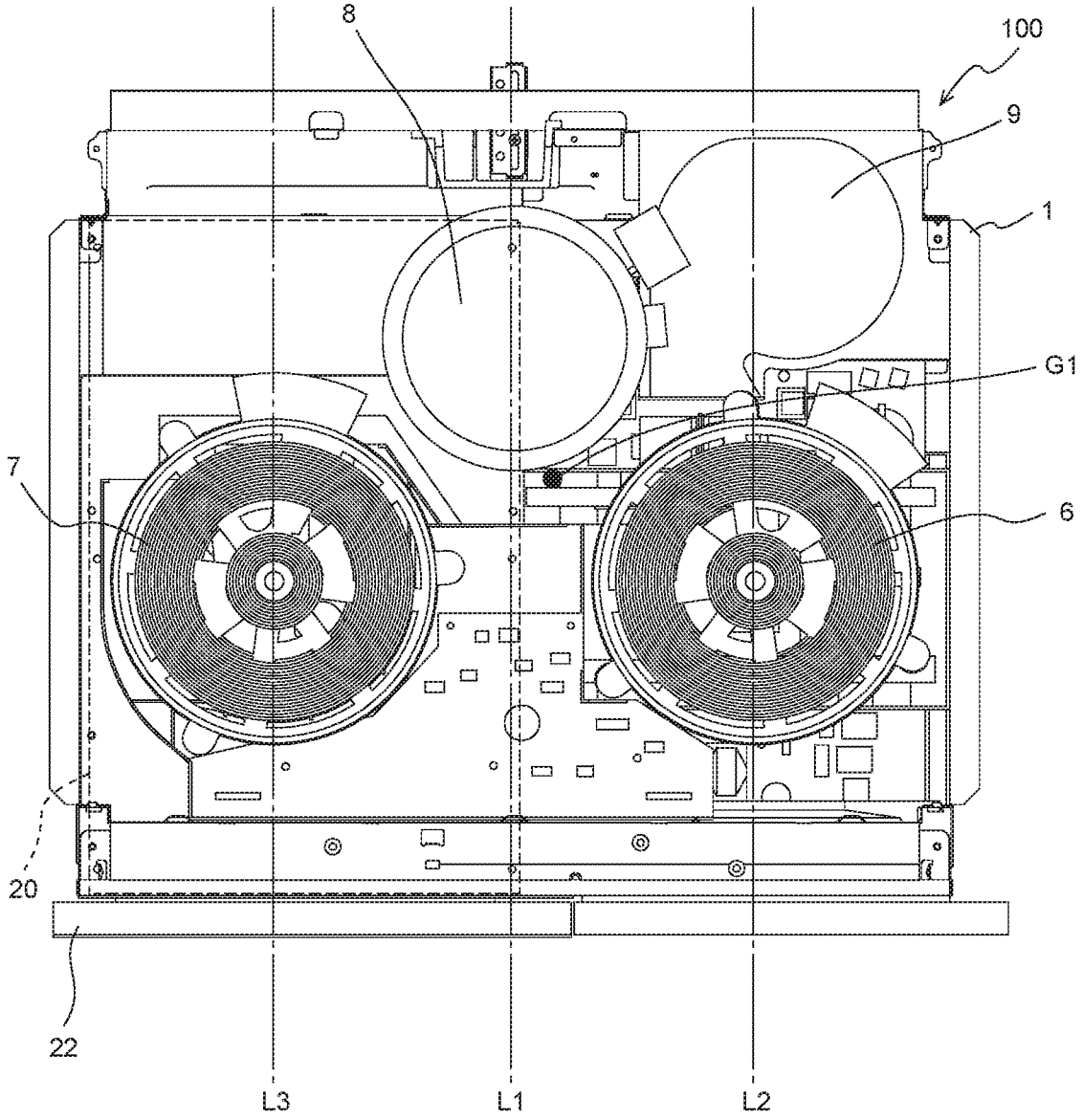
FIG. 7 is a diagram illustrating the center of gravity of the cooker according to Embodiment 1.

FIG. 7 is a diagram illustrating the center of gravity of the cooker according to Embodiment 1. FIG. 7 is a plan view of the cooker 100 seen through the top plate 2. In FIG. 7, the width-direction center of the first heating coil 6, which is one of the plurality of heaters that is at the rightmost position in the housing 1, is represented by a one-dot chain line denoted by reference sign L2. Furthermore, the width-direction center of the second heating coil 7, which is one of the plurality of heaters that is at the leftmost position in the housing 1, is represented by a one-dot chain line denoted by reference sign L3. The center of gravity of the cooker 100 is denoted by reference sign G1.

Herein, the center of gravity of the cooker 100 refers to the center of gravity of the cooker 100 that is in a state ready to be carried for transport or installation. In Embodiment 1, the center of gravity of the cooker 100 is regarded as the center of gravity of the cooker 100 in a state where all of the components, including the partition 21 of the storage 20, the storage door 22, the storage case 23, the fixed rails 24, and the movable rails 25, necessary for performing the normal heating operation (all of the elements of the cooker 100 illustrated in FIG. 3) are set.

As illustrated in FIG. 7, the components forming the cooker 100 are positioned in such a manner that the center of gravity G1 of the cooker 100 is positioned closer to the center line L1 than the width-direction ends (the left and right ends) of the housing 1. More preferably, the components forming the cooker 100 are positioned in such a manner that the center of gravity G1 of the cooker 100 is positioned on the width-direction center line L1 of the housing 1. Thus, the weight borne by the worker when the worker holds the left and right of the cooker 100 is well-balanced in the lateral direction. Consequently, the portability of the cooker 100 can be improved.

As the positional relationship among the center of gravity G1 of the cooker 100 and the heaters, the center of gravity G1 of the cooker 100 is positioned between the centers of two of the plurality of heaters that are each positioned at a corresponding one of the width-direction ends of the housing 1, that is, between the center line L2 of the first heating coil 6 and the center line L3 of the second heating coil 7.

As the positional relationship among the heaters and the storage 20, at least part of the storage 20 is positioned between the centers of two of the plurality of heaters that are each positioned at a corresponding one of the width-direction ends of the housing 1, that is, between the center line L2 of the first heating coil 6 and the center line L3 of the second heating coil 7.

FIG. 7 illustrates an exemplary arrangement in which two heaters, namely the first heating coil 6 and the second heating coil 7, having substantially the same outside diameter and substantially the same mass are laterally positioned in the width direction of the housing 1. Alternatively, a first heating coil 6 and a second heating coil 7 having different masses may be employed. In such a case, in a plan view of the housing 1, the heating coil having the greater mass is positioned in such a manner that a major area of the heating coil having the greater mass coincides with an area of the storage 20. Thus, the storage 20 that is empty at the time of transport or installation and the relatively heavier one of the heating coils overlap each other. Hence, the weight borne by the worker when the worker holds the left and right of the cooker 100 is well-balanced in the lateral direction. Consequently, the portability of the cooker 100 can be improved.

The partition 21 that defines the storage 20 may be made of metal, and the substrate 10*a* of the circuit board 10 may be made of a material having a smaller specific gravity than a specific gravity of metal. In the configuration illustrated in FIG. 7, when the center of gravity G1 is positioned closer to the circuit board 10 than the center line L1, the center of gravity G1 can be set closer to the center line L1 of the housing 1 by making the partition 21 heavier than the substrate 10*a*.

Embodiment 2

Embodiment 2 differs from Embodiment 1 in the number of storages provided in the housing 1. Embodiment 2 will be described below, focusing on the difference from Embodiment 1.

Figure 8:
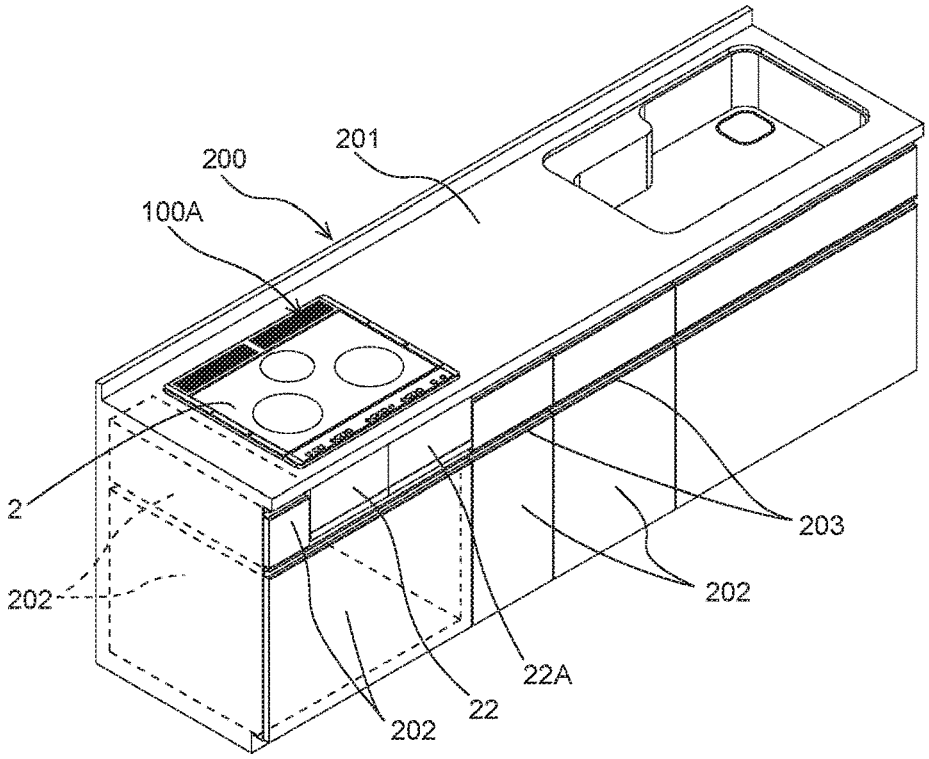
FIG. 8 is a perspective view of a kitchen furniture item equipped with a cooker according to Embodiment 2.
Figure 9:
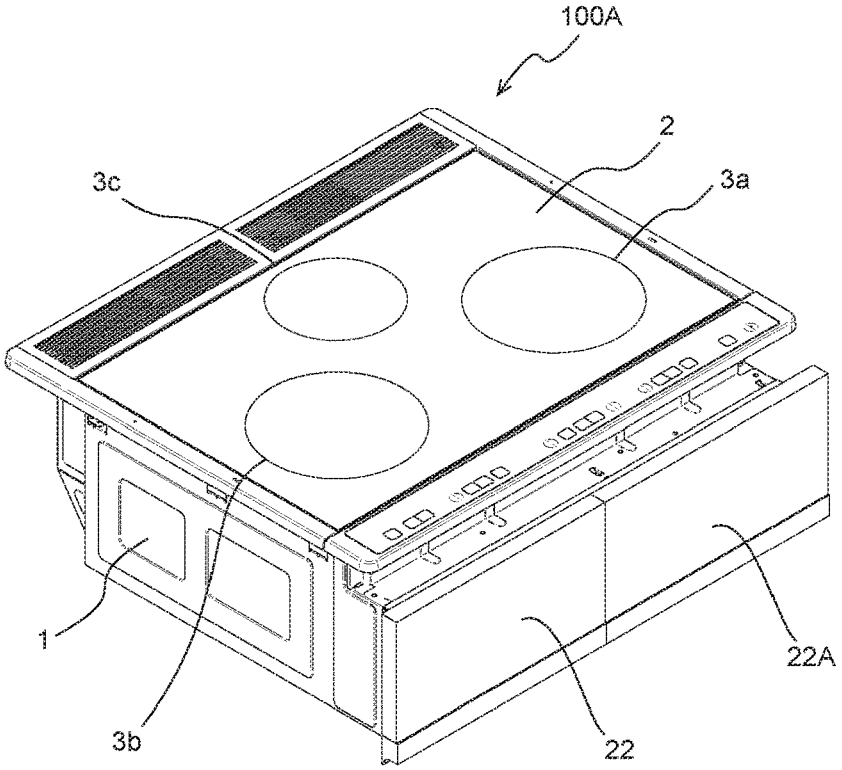
FIG. 9 is a perspective view of the cooker according to Embodiment 2.
Figure 10:
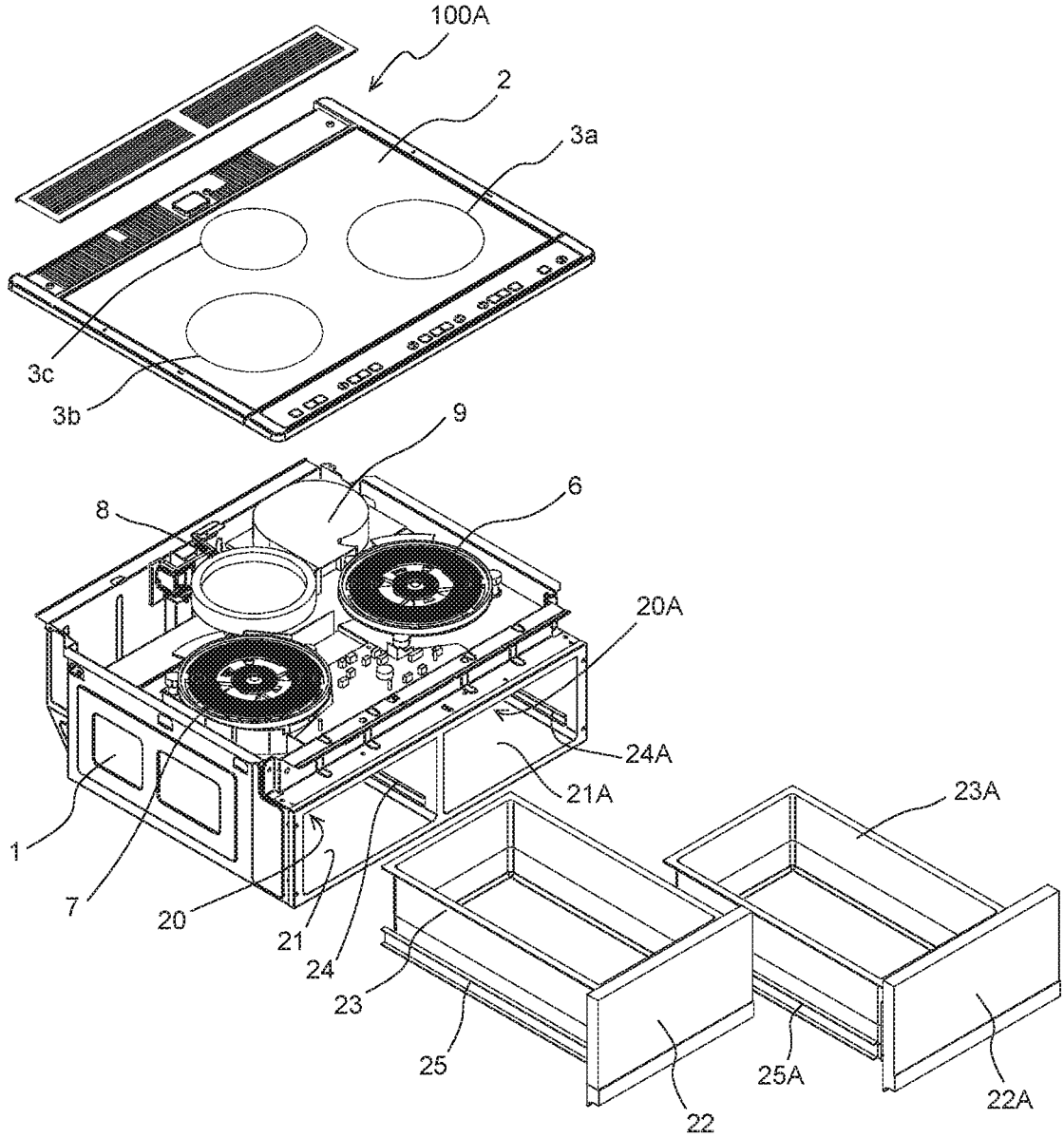
FIG. 10 is an exploded perspective view of the cooker according to Embodiment 2.

FIG. 8 is a perspective view of a kitchen furniture item equipped with a cooker according to Embodiment 2. FIG. 9 is a perspective view of the cooker according to Embodiment 2. FIG. 10 is an exploded perspective view of the cooker according to Embodiment 2. A cooker 100A according to Embodiment 2 includes two storages 20 and 20A. The storage 20 and the storage 20A have substantially the same size and are laterally arranged in the width direction of the housing 1. A partition 21A that defines the storage 20A, a storage door 22A that opens and closes an opening at the front face of the storage 20A, a storage case 23A, fixed rails 24A, and movable rails 25A have the same configurations as the configurations of the partition 21, the storage door 22, the storage case 23, the fixed rails 24, and the movable rails 25 for the storage 20 described in Embodiment 1.

Figure 11:
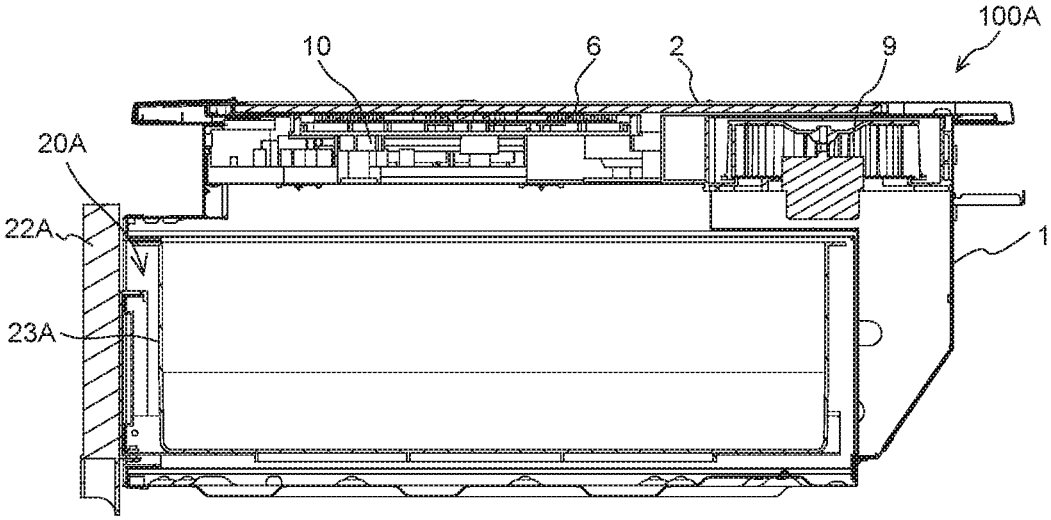
FIG. 11 is a sectional view of the cooker according to Embodiment 2, passing through a storage in a direction from the front to the rear of the cooker.
Figure 12:
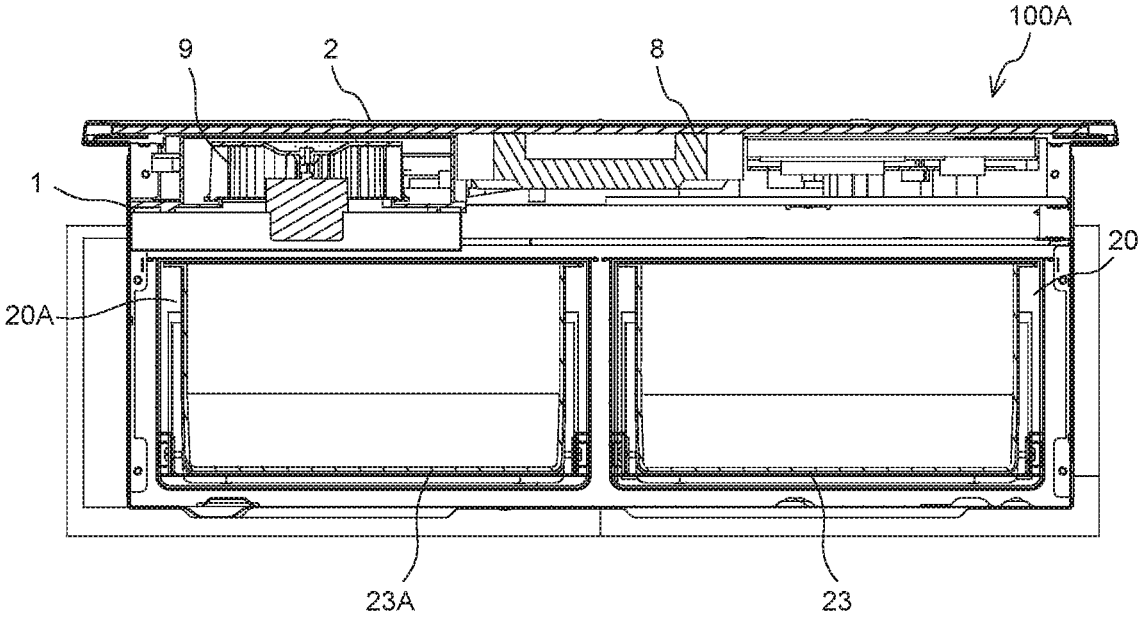
FIG. 12 is a lateral sectional view of the cooker according to Embodiment 2, passing through the storages.

FIG. 11 is a sectional view of the cooker according to Embodiment 2, passing through the storage in a direction from the front to the rear of the cooker. FIG. 11 illustrates a section passing through the storage 20A provided in the right portion of the housing 1 in the width direction. FIG. 12 is a lateral sectional view of the cooker according to Embodiment 2, passing through the storages. FIG. 12 illustrates a section passing through the air-sending device 9 and seen from the rear of the cooker 100A. As illustrated in FIGS. 10 to 12, the first heating coil 6, the second heating coil 7, the radiant heater 8, the air-sending device 9, and the circuit board 10 according to Embodiment 2 are positioned above the storage 20 and the storage 20A.

The storage 20 and accessory components of the storage 20 have the same configuration as the configuration of the storage 20A and accessory components of the storage 20A. Consequently, the center of gravity of a set of the storage 20 and the storage 20A is positioned at substantially the width-direction center of the housing 1. Hence, the center of gravity of the set of the storage 20 and the storage 20A is less likely to adversely affect the balance of the weight borne by the worker when the worker holds the left and right of the cooker 100A.

When each of the centers of gravity of associated elements included in the cooker 100A is seen in the height direction of the housing 1, the center of gravity of each of the first heating coil 6, the second heating coil 7, the radiant heater 8, the air-sending device 9, and the circuit board 10 is positioned above the height-direction center of the housing 1. Furthermore, the center of gravity of each of the storage 20 and the storage 20A is positioned below the height-direction center of the housing 1. As the centers of gravity of major elements of the cooker 100A are each provided to a corresponding one of one portion and the other portion in the height direction as described above, the ease of transport and the ease of installation of the cooker 100A can be increased.

In Embodiment 2 as well, it is preferable that the center of gravity of the cooker 100A be positioned closer to the width-direction center of the housing 1 than the width-direction ends (the left and right ends) of the housing 1. In Embodiment 2, the storage 20 and the storage 20A having substantially the same configuration and substantially the same size are laterally arranged in the width direction of the housing 1. Consequently, it is easy to set the center of gravity of the set of the storage 20 and the storage 20A at a position close to the width-direction center of the housing 1. Thus, it is easy to set the center of gravity of the cooker 100A at a position close to the width-direction center of the housing 1 by adjusting the positions of the components provided above the storage 20A. As the center of gravity of the cooker 100A is set close to the width-direction center of the housing 1 as described above, the weight borne by the worker when the worker holds the left and right of the cooker 100A is well-balanced in the lateral direction. The portability of the cooker 100A can be improved, accordingly. Consequently, the ease of transport of the cooker 100 and the ease of work at the time of installation of the cooker 100 can be made better.

Embodiment 3

Embodiment 3 differs from Embodiment 1 in the shape of the storage provided in the housing 1. Embodiment 3 will be described below, focusing on the difference from Embodiment 1.

Figure 13:
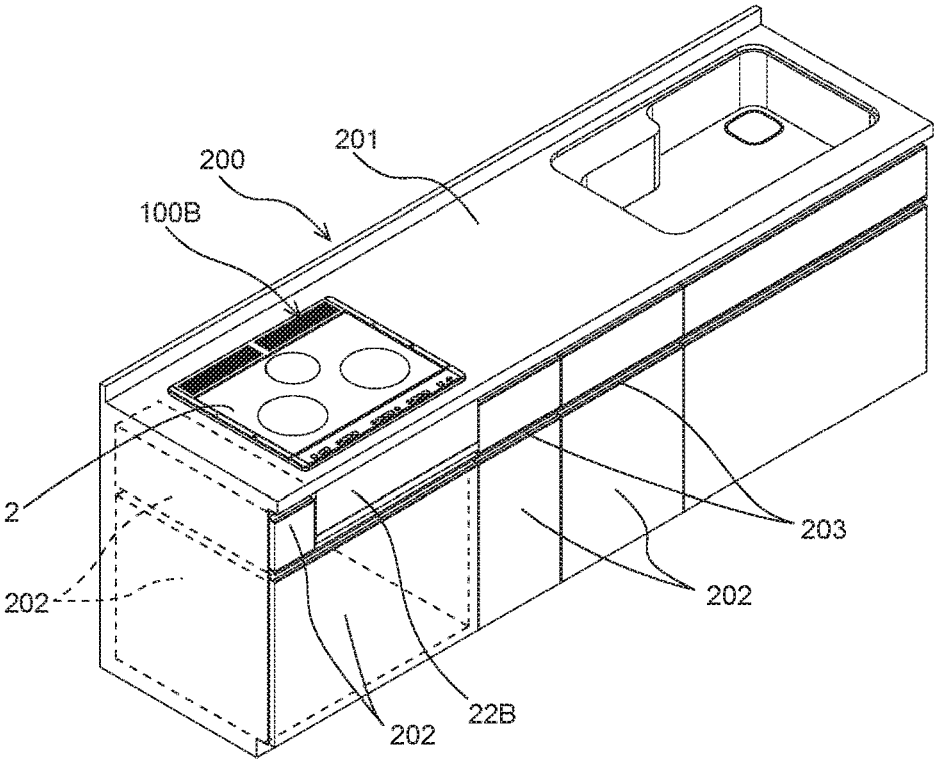
FIG. 13 is a perspective view of a kitchen furniture item equipped with a cooker according to Embodiment 3.
Figure 14:
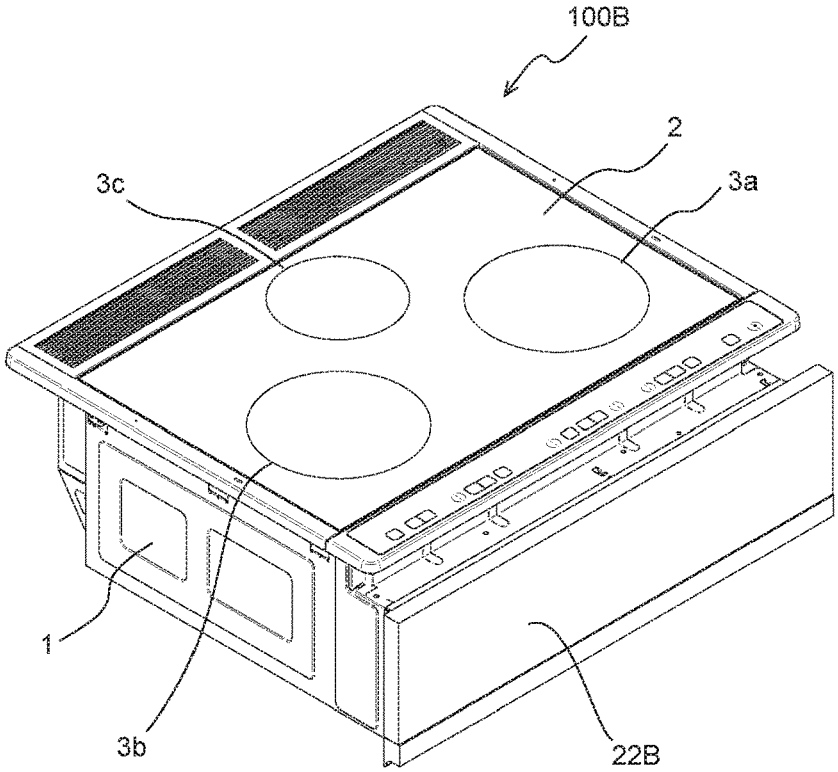
FIG. 14 is a perspective view of the cooker according to Embodiment 3.
Figure 15:
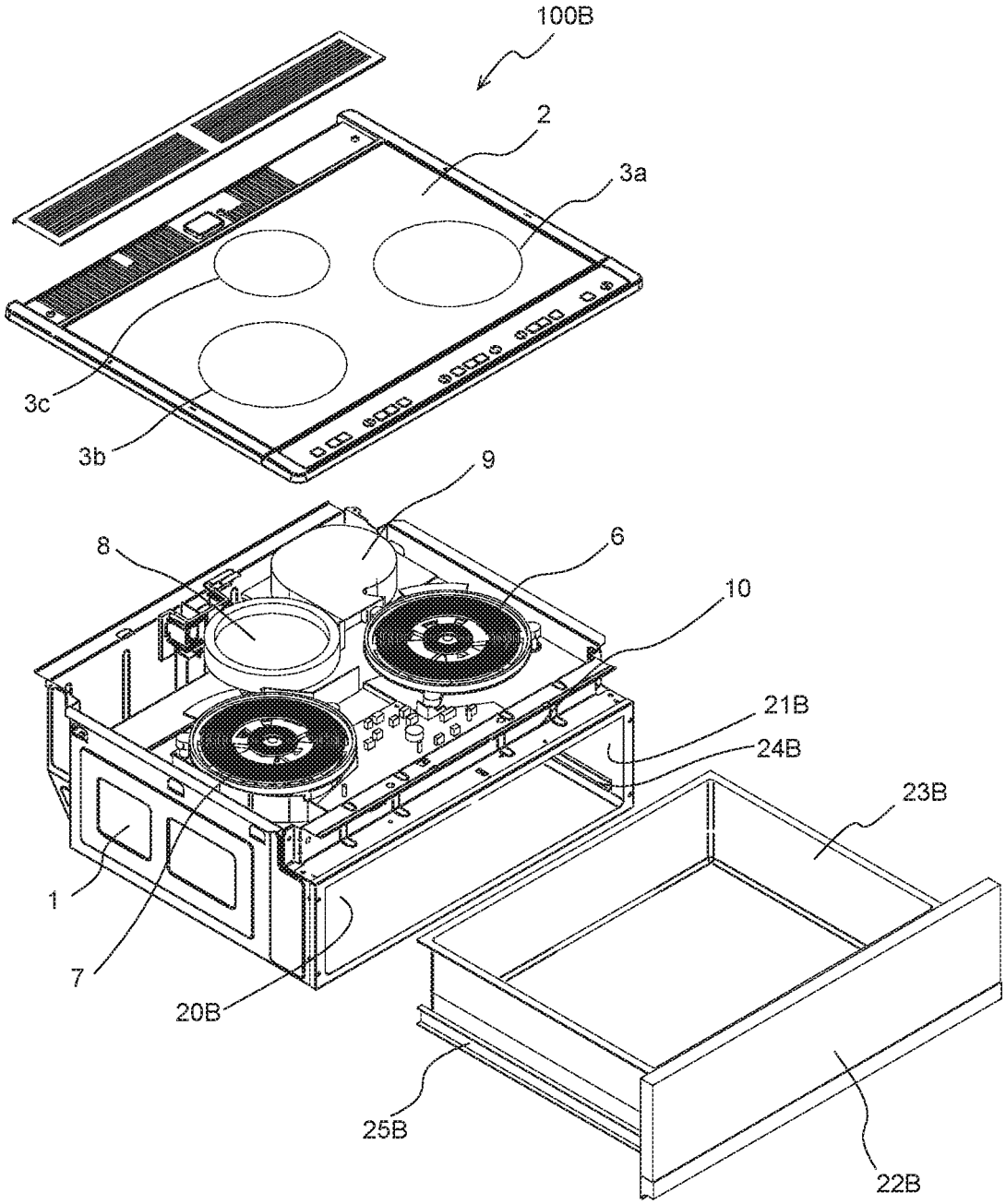
FIG. 15 is an exploded perspective view of the cooker according to Embodiment 3.

FIG. 13 is a perspective view of a kitchen furniture item equipped with a cooker according to Embodiment 3. FIG. 14 is a perspective view of the cooker according to Embodiment 3. FIG. 15 is an exploded perspective view of the cooker according to Embodiment 3. Similarly to the cooker 100 according to Embodiment 1, a cooker 100B according to Embodiment 3 has a single storage 20B, but differs from Embodiment 1 in the size and the position of the storage 20B. As illustrated in FIGS. 13 to 15, the storage 20B is positioned at the width-direction center of the housing 1. Furthermore, the storage 20B extends over a major area of the right area of the housing 1 and a major area of the left area of the housing 1, and the right area is across the width-direction center of the housing 1 from the left area. Preferably, left and right walls of a partition 21B defining the storage 20B are each positioned close to a corresponding one of the left and right faces of the housing 1 in such a manner that the inside dimension of the housing 1 and the inside dimension of the storage 20B are substantially the same. Thus, the storable capacity of the storage 20B can be increased. A storage door 22B, a storage case 23B, fixed rails 24B, and movable rails 25B provided for the storage 20B according to Embodiment 3 have different sizes and are provided at different positions from those of the storage door 22, the storage case 23, the fixed rails 24, and the movable rails 25 provided for the storage 20 described in Embodiment 1 but each have the same function as a corresponding one of those described in Embodiment 1.

As illustrated in FIG. 15, in Embodiment 3, the first heating coil 6, the second heating coil 7, the radiant heater 8, the air-sending device 9, and the circuit board 10 are positioned above the storage 20B.

Furthermore, the center of gravity of a set of the first heating coil 6, the second heating coil 7, the radiant heater 8, the air-sending device 9, and the circuit board 10 is positioned above the height-direction center of the housing 1, whereas the center of gravity of the storage 20B is positioned below the height-direction center of the housing 1. As the centers of gravity of major elements of the cooker 100B are each provided to a corresponding one of one portion and the other portion in the height direction as described above, the ease of transport and the ease of installation of the cooker 100B can be increased.

In Embodiment 3 as well, it is preferable that the center of gravity of the cooker 100B be positioned closer to the width-direction center of the housing 1 than the width-direction ends (the left and right ends) of the housing 1. In Embodiment 3, the storage 20B has a width that is substantially the same as the inside dimension of the housing 1 in the width direction. Consequently, it is easy to set the center of gravity of the storage 20B at a position close to the width-direction center of the housing 1. Thus, it is easy to set the center of gravity of the cooker 100B at a position close to the width-direction center of the housing 1 by adjusting the positions of the components provided above the storage 20B. As the center of gravity of the cooker 100B is set close to the width-direction center of the housing 1 as described above, the weight borne by the worker when the worker holds the left and right of the cooker 100B is well-balanced in the lateral direction. The portability of the cooker 100B can be improved, accordingly. Consequently, the ease of transport of the cooker 100 and the ease of work at the time of installation of the cooker 100 can be made better.

Embodiment 4

Embodiment 4 employs a configuration in which a storage provided in the housing 1 can selectively house a storage case or a heater unit including a heating chamber. Embodiment 4 will be described below, focusing the difference from Embodiment 2. A state where a cooker 100C according to Embodiment 4 is accommodated in the kitchen furniture item 200 is the same as the state illustrated in FIG. 8.

Figure 16:
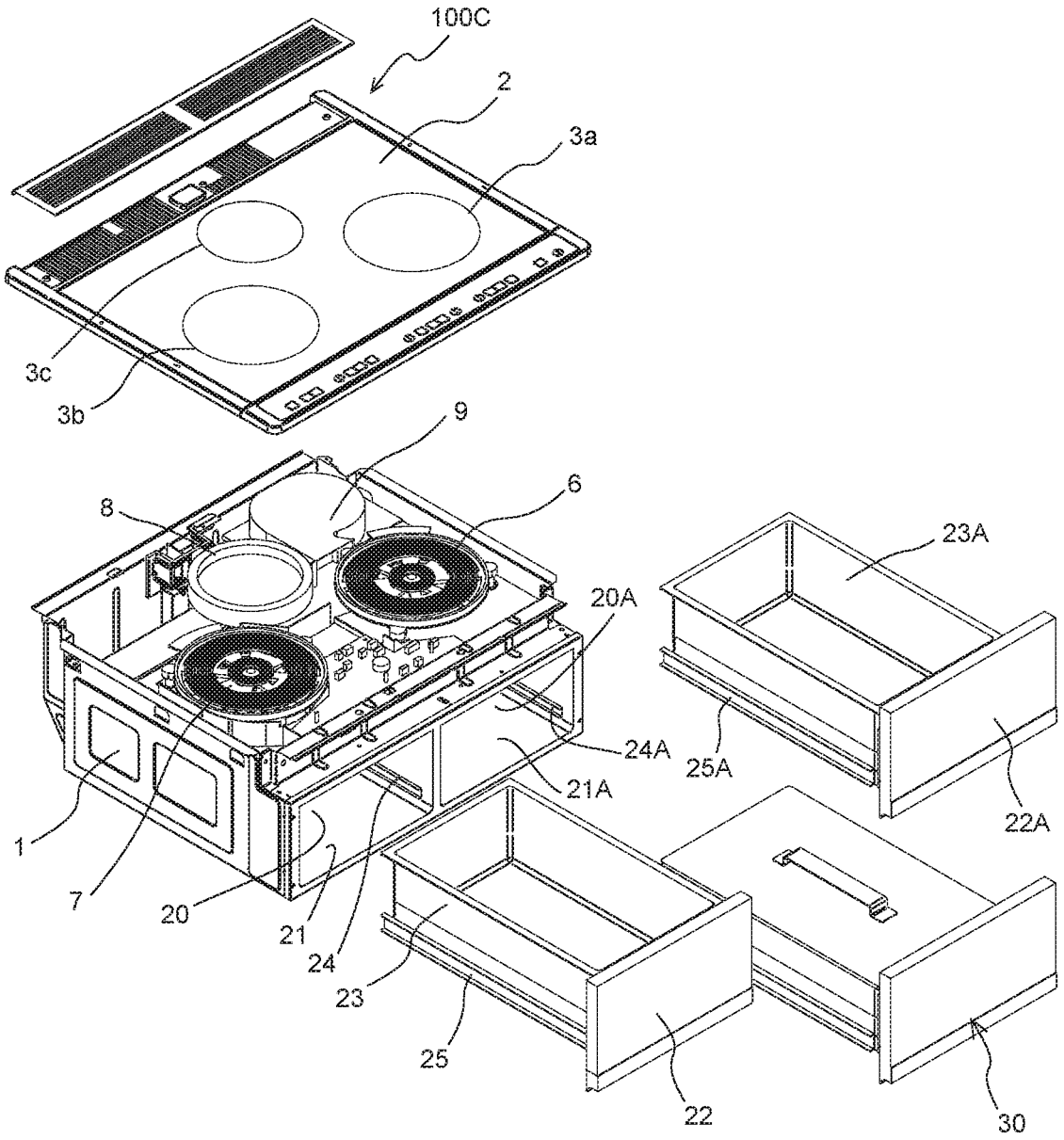
FIG. 16 is an exploded perspective view of a cooker according to Embodiment 4.

FIG. 16 is an exploded perspective view of the cooker according to Embodiment 4. The cooker 100C includes two storage 20 and 20A as with the case of Embodiment 2. The storage 20A selectively accommodates the storage case 23A described in Embodiment 2 or a heater unit 30.

Figure 17:
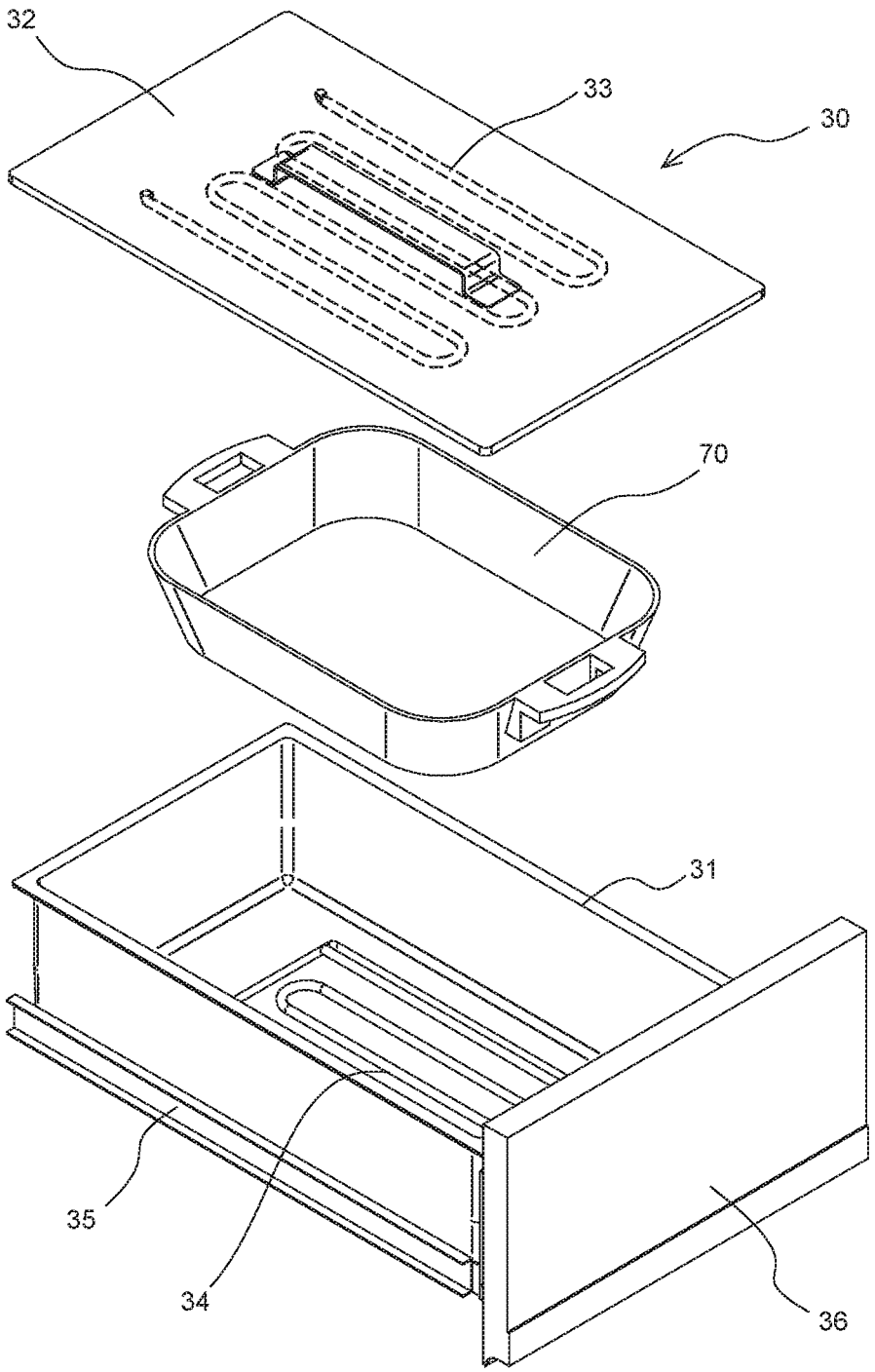
FIG. 17 is an exploded perspective view of a heater unit according to Embodiment 4.

FIG. 17 is an exploded perspective view of the heater unit according to Embodiment 4. The heater unit 30 includes a heater case 31 that defines a heating chamber and whose top face is open, and a lid part 32 that covers the opening at the top face of the heater case 31 in such a manner that the opening is allowed to be open and closed. The lid part 32 is provided with an upper heater 33. The heater case 31 is provided with a lower heater 34 at the bottom of the heater case 31. The upper heater 33 and the lower heater 34 that are second heaters heat the heating chamber defined by the heater case 31 and are each, for example, an electric heater, a heating coil, or any other similar device. Note that only one of the upper heater 33 and the lower heater 34 may be provided. Moreover, the heater may be provided on a side face of the heater case 31. The present invention is not limited to the number, the arrangement, and the specific configuration of heaters that heat the heating chamber.

The cooker 100C includes a non-illustrated power-feeding mechanism that feeds power to the upper heater 33 and the lower heater 34 of the heater unit 30. In a state where the heater unit 30 is accommodated in the storage 20A, contact points of the power-feeding mechanism are electrically connected to contact points of the upper heater 33 and the lower heater 34 in such a manner that power is fed to the upper heater 33 and the lower heater 34.

A pair of left and right movable rails 35 are each provided at a lower portion of a corresponding one of the left and right outer surfaces of the heater case 31. The movable rail 35 is in engagement with each of the fixed rails 24 provided on the partition 21B of the storage 20A in such a manner that the movable rail 35 is allowed to be slid. The movable rails 35 are configured to be detached from and attached to the fixed rails 24A. The heater case 31 is provided, on the front portion of the heater case 31, with a substantially flat plate-like heater-case door 36. The heater-case door 36 opens and closes the open part at the front face of the storage 20A, as with the storage door 22A.

The heater case 31 of the heater unit 30 configured as described above can store and heat, as illustrated in FIG. 17, the cooking pan 70 to be heated on the top plate 2.

Figure 18:
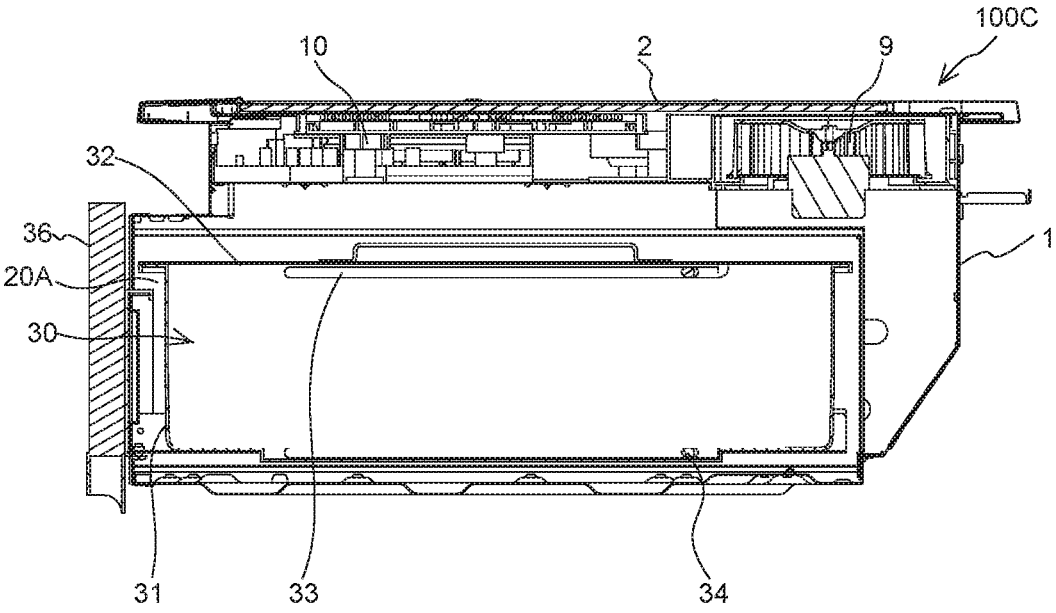
FIG. 18 is a sectional view of the cooker according to Embodiment 4, passing through a storage in a direction from the front to the rear of the cooker.
Figure 19:
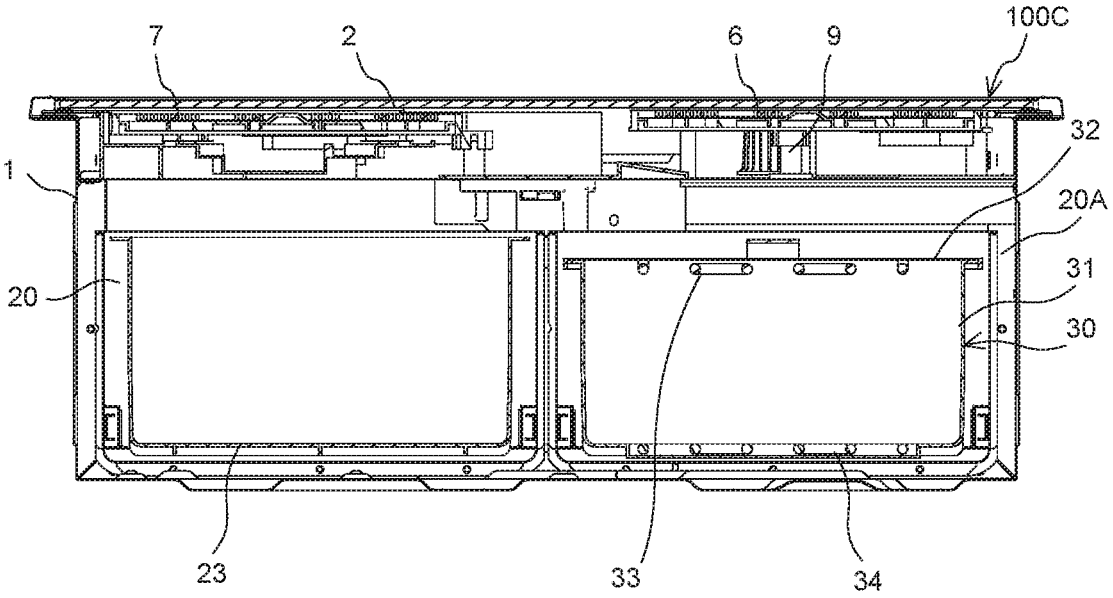
FIG. 19 is a lateral sectional view of the cooker according to Embodiment 4, passing through the storages.

FIG. 18 is a sectional view of the cooker according to Embodiment 4, passing through the storage in a direction from the front to the rear of the cooker. FIG. 18 illustrates a section passing through the storage 20A with the heater unit 30 accommodated the storage 20A. FIG. 19 is a lateral sectional view of the cooker according to Embodiment 4, passing through the storages. FIG. 19 illustrates a section passing through the air-sending device 9 and seen from the front of the cooker 100C. Except the heater unit 30 accommodated in the storage 20A, the cooker 100C has the same configuration as the configuration of the cooker 100A according to Embodiment 2.

Embodiment 4 can produce the same advantageous effects as those produced by Embodiment 2. Furthermore, as the heater unit 30 that is storable in the storage 20A is employed, the flexibility in cooking by the user can be improved. Consequently, the ease of use of the cooker 100C can be increased.

A heat-insulating layer may be provided between the storage 20A that accommodates the heater unit 30 and the storage 20 adjacent to the storage 20A. The heat-insulating layer in such a case may be an air layer provided in a gap between two flat plate-like parts. Instead of the air layer or in addition to the air layer, a heat-insulating material may be provided. The heat-insulating material may be, for example, a synthetic resin material, a rubber-based or urethane-based closed-cell foam material, glass fibers, ceramic fibers, and any of other similar materials. In such a case, the heat-insulating characteristic of the storage 20 against the heat generated by the heater unit 30 is improved, and the rise of the temperature in the storage 20 can be reduced. The deterioration of the pieces of stuff in the storage 20 due to the heat can be reduced, accordingly. Furthermore, an odd feeling and an uncomfortable feeling that may occur to the user because of the heat transmitted to the user when the storage door 22 of the storage 20 is opened can be reduced.

While Embodiment 4 employs two storages 20 and 20A, another configuration in which the heater unit 30 is storable in the storage 20 or 20B described in Embodiment 1 or 3 may be employed.

While Embodiments 1 to 4 each employ a built-in-type cooker whose housing 1 is to be accommodated in an accommodating portion provided in a kitchen furniture item 200, the present invention may also be applied to a stand-alone-type cooker.

REFERENCE SIGNS LIST

1 housing 2 top plate 3*a* cooking zone 3*b* cooking zone 3*c* cooking zone 6 first heating coil 7 second heating coil 8 radiant heater 9 air-sending device 10 circuit board 10*a* substrate 10*b* inverter 11 coil-cooling duct 12 first facing wall 13 second facing wall 20 storage 20A storage 20B storage 21 partition 21A partition 21B partition 22 storage door 22A storage door 22B storage door 23 storage case 23A storage case 23B storage case 24 fixed rail 24A fixed rail 24B fixed rail 25 movable rail 25A movable rail 25B movable rail 30 heater unit 31 heater case 32 lid part 33 upper heater 34 lower heater 35 movable rail 36 heater-case door 70 cooking pan 100 cooker 100A cooker 100B cooker 100C cooker 200 kitchen furniture item 201 top board 202 kitchen storage 203 kitchen-storage door 204 handhold G1 center of gravity G2 center of gravity G3 center of gravity L1 center line L2 center line L3 center line

The invention claimed is:

1. A cooker, comprising:

a top plate provided with a plurality of cooking zones on any of which a heating object is to be placed;

a plurality of heaters, wherein each of the heaters is provided in a corresponding one of the cooking zones;

a housing provided below the top plate and accommodating the plurality of heaters;

a storage defined by a partition and provided in the housing;

a door configured to cover an opening provided at the housing and communicating with the storage;

a storage case attached to the door and stored in the storage;

an air-sending device provided in the housing; and a circuit board provided in the housing and on which a drive circuit configured to drive the plurality of heaters is mounted, wherein a center of gravity of the cooker is positioned closer to a width-direction center of the housing than a width-direction end of the housing, the storage is positioned entirely in a first portion of the housing, which is located above or below a second portion of the housing, the air-sending device and the circuit board are positioned entirely in the second portion.

2. The cooker of claim 1, wherein the plurality of heaters are positioned in such a manner that the center of gravity of the cooker is positioned between centers of two of the plurality of heaters that are each positioned at a corresponding one of two width-direction ends of the housing.

3. The cooker of claim 1, wherein the storage is positioned in such a manner that at least part of the storage is positioned between centers of two of the plurality of heaters that are each positioned at a corresponding one of two width-direction ends of the housing.

4. The cooker of claim 1, wherein, in plan view, a major area of the storage is positioned in a first area, which is across a width-direction center of the housing from a second area in the housing, and wherein, in plan view, a major area of each of the air-sending device and the circuit board is positioned in the second area.

5. The cooker of claim 1, wherein the storage includes two storages, and wherein the two storages are laterally arranged in a width direction of the housing.

6. The cooker of claim 1, wherein the storage is made of metal, and wherein the circuit board includes a substrate made of a material having a smaller specific gravity than a specific gravity of the metal.

7. The cooker of claim 1, wherein the storage is a single storage, and wherein the storage extends over a major area of a first area of the housing and a major area of a second area of the housing, the first area being across a width-direction center of the housing from the second area.

8. A cooker, comprising:

a top plate provided with a plurality of cooking zones on any of which a heating object is to be placed;

a plurality of heaters, wherein each of the heaters is provided in a corresponding one of the cooking zones;

a housing provided below the top plate and accommodating the plurality of heaters;

a storage defined by a partition and provided in the housing;

an air-sending device provided in the housing; and a circuit board provided in the housing and on which a drive circuit configured to drive the plurality of heaters is mounted, wherein the plurality of heaters includes a first heating coil and a second heating coil, and the second heating coil has a mass that is greater than a mass of the first heating coil, in plan view, a major area of the second heating coil coincides with an area of the storage, the storage is positioned entirely in a first portion, which is located above or below a second portion of the housing, the air-sending device and the circuit board are positioned entirely in the second portion.

9. The cooker of claim 8, further comprising:

a storage case that is storable in the storage; and a heater unit including a heater case defining a heating chamber, and a second heater configured to heat an inside of the heating chamber, the heater unit being storable in the storage, wherein the storage case or the heater unit is selectively stored in the storage.

10. The cooker of claim 8, wherein, in plan view, a major area of the storage is positioned in a first area, which is across a width-direction center of the housing from a second area in the housing, and wherein, in plan view, a major area of each of the air-sending device and the circuit board is positioned in the second area.

11. The cooker of claim 8, wherein the storage includes two storages, and wherein the two storages are laterally arranged in a width direction of the housing.

12. The cooker of claim 8, wherein the storage is made of metal, and wherein the circuit board includes a substrate made of a material having a smaller specific gravity than a specific gravity of the metal.

13. The cooker of claim 8, wherein the storage is a single storage, and wherein the storage extends over a major area of a first area of the housing and a major area of a second area of the housing, the first area being across a width-direction center of the housing from the second area.

* * * * *